US011085255B2

(12) United States Patent
Fossli

(10) Patent No.: US 11,085,255 B2
(45) Date of Patent: Aug. 10, 2021

(54) SYSTEM AND METHODS FOR CONTROLLED MUD CAP DRILLING

(71) Applicant: Enhanced Drilling A.S., Straume (NO)

(72) Inventor: Børre Fossli, Oslo (NO)

(73) Assignee: Enhanced Drilling A.S., Straume (NO)

( * ) Notice: Subject to any disclaimer, the term of this patent is extended or adjusted under 35 U.S.C. 154(b) by 0 days.

(21) Appl. No.: 16/920,820

(22) Filed: Jul. 6, 2020

(65) Prior Publication Data

US 2020/0399965 A1 Dec. 24, 2020

Related U.S. Application Data

(60) Division of application No. 16/184,528, filed on Nov. 8, 2018, now Pat. No. 10,787,871, which is a continuation of application No. PCT/US2017/052823, filed on May 12, 2017.

(60) Provisional application No. 62/335,117, filed on May 12, 2016.

(51) Int. Cl.

| | |
|---|---|
| ***E21B 21/00*** | (2006.01) |
| ***E21B 21/08*** | (2006.01) |
| ***E21B 43/38*** | (2006.01) |
| ***E21B 47/047*** | (2012.01) |

(52) U.S. Cl.

CPC ..... *E21B 21/001* (2013.01); *E21B 21/003* (2013.01); *E21B 21/08* (2013.01); *E21B 43/38* (2013.01); *E21B 47/047* (2020.05); *E21B 21/085* (2020.05)

(58) Field of Classification Search

CPC ..... E21B 21/001; E21B 21/003; E21B 21/08; E21B 43/38; E21B 47/047

See application file for complete search history.

(56) References Cited

U.S. PATENT DOCUMENTS

| | | | | |
|---|---|---|---|---|
| 4,919,218 | A | 4/1990 | William | |
| 9,322,232 | B2 * | 4/2016 | Rajabi | E21B 21/08 |
| 9,506,305 | B2 * | 11/2016 | Leuchtenberg | E21B 33/064 |
| 9,605,502 | B2 * | 3/2017 | Leuchtenberg | E21B 33/038 |
| 10,724,315 | B2 * | 7/2020 | Leuchtenberg | E21B 21/08 |

(Continued)

FOREIGN PATENT DOCUMENTS

| | | | |
|---|---|---|---|
| WO | 03/093642 | A1 | 11/2003 |
| WO | 2006/118920 | A2 | 11/2006 |

(Continued)

OTHER PUBLICATIONS

International Search Report, International Application No. PCT/IB2017/052823 dated Nov. 13, 2017.

(Continued)

*Primary Examiner* — Matthew R Buck

(74) *Attorney, Agent, or Firm* — Richard A. Fagin

(57) ABSTRACT

A subsea drilling method for controlling the bottom hole annular pressure and downward injection rate during mud cap drilling operations from a mobile offshore drilling unit with a low pressure marine riser and subsea blowout preventer. The method called controlled mud cap drilling uses the hydrostatic head of a heavy annular mud (fluid) managed or observed in order to balance the highest pore pressure in the well and to control the injection rate, by using a subsea mud lift pump and a control system to regulate the process.

10 Claims, 6 Drawing Sheets

(56) References Cited

U.S. PATENT DOCUMENTS

| | | | | |
|---|---|---|---|---|
| 2007/0119621 | A1* | 5/2007 | Stave | E21B 21/001 175/5 |
| 2009/0188718 | A1 | 7/2009 | Kaafeson-Loe et al. | |
| 2010/0147773 | A1 | 6/2010 | Kouba et al. | |
| 2012/0211234 | A1 | 8/2012 | Len et al. | |
| 2015/0008036 | A1* | 1/2015 | Ree | E21B 7/12 175/5 |

FOREIGN PATENT DOCUMENTS

| | | | |
|---|---|---|---|
| WO | 2009/123476 | A1 | 10/2009 |
| WO | 2011/058031 | A2 | 5/2011 |
| WO | 2012/0091706 | A1 | 7/2012 |

OTHER PUBLICATIONS

Written Opinion Concerning Patentability, International Application No. PCT/IB2017/052823 dated Nov. 13, 2017.
Communication Pursuant to Rule 164(2)(b) and Art. 94(3), Application No. 17 730 932.5-1002 dated Jun. 25, 2020.
Extended European Search Report dated Oct. 16, 2019, Application No. 19185330.8.

* cited by examiner

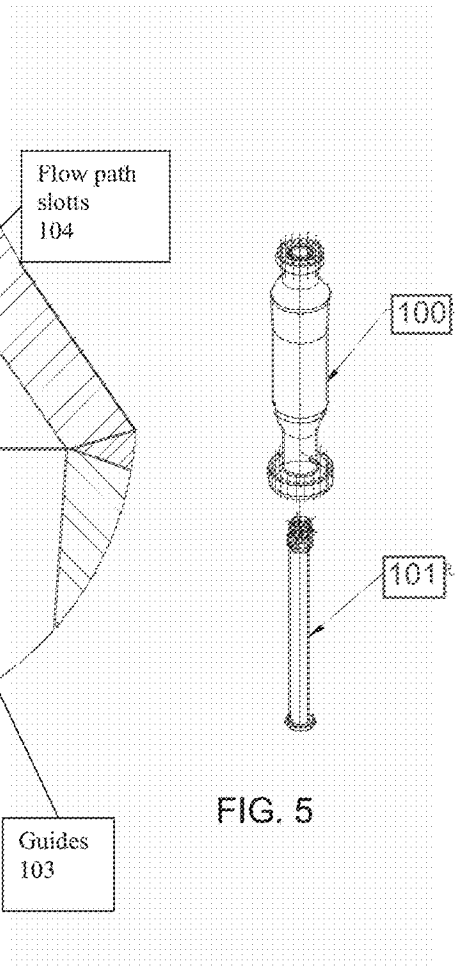
FIG. 5
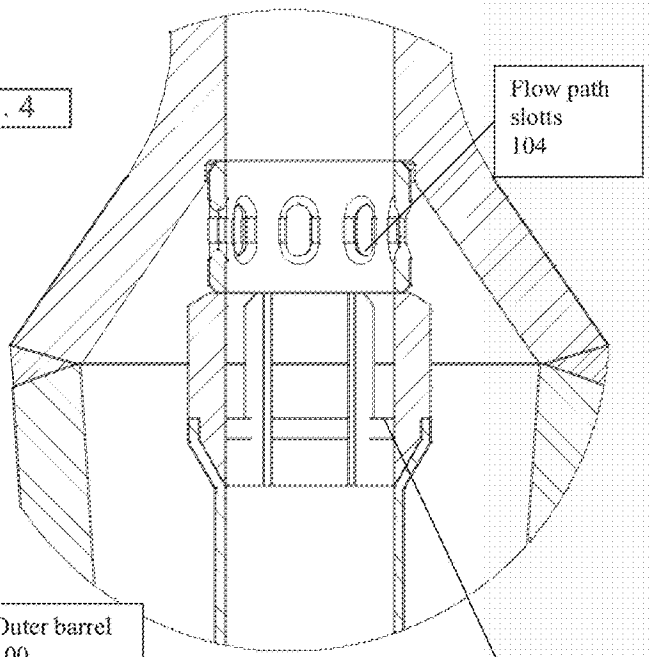
FIG. 4
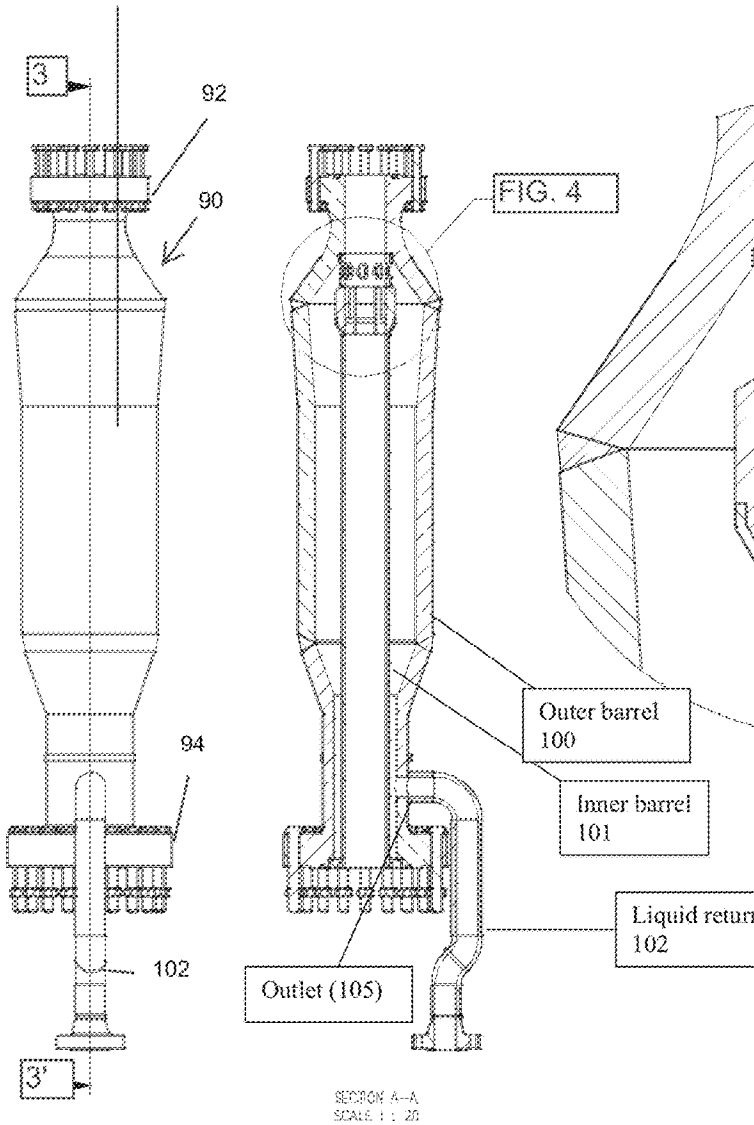
FIG. 3
FIG. 2

SYSTEM AND METHODS FOR CONTROLLED MUD CAP DRILLING

CROSS REFERENCE TO RELATED APPLICATIONS

Divisional of U.S. patent application Ser. No. 16/184,528 filed on Nov. 8, 2018, which is a continuation of International Application No. PCT/IB2017/052823 filed on May 12, 2017. Priority is claimed from U.S. Provisional Application No. 62/335,117 filed on May 12, 2016. All the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

The present disclosure relates to systems, methods and arrangements for drilling subsea wells, while being able to manage and regulate the annular pressure profile in the wellbore when there are no returns up the annulus of the well between the drill pipe and casing and/or open-hole section of the well.

Marine drilling in deeper water, through depleted sub-bottom reservoir formations or into severely (naturally) fractured basement, fractured carbonate formations which often are karstified (containing karsts or caves), is a challenge and is impracticable to be performed with conventional drilling methods.

In conventional marine wellbore drilling, drilling fluid is pumped down a drill string, through a drill bit at the bottom of the drill string and returns up an annular space (annulus) between the drill sting and open drilled wellbore, well casing and marine riser to a drilling platform on the water surface. The drilling fluid carries and transports drilled out solids of the sub-bottom formations to the drilling platform where the returned drilling fluid can be processed, e.g., have dissolved and/or entrained gas removed and to remove drill cuttings and other wellbore-sourced contaminants from the drilling fluid. Another feature of the drilling fluid is to build a filter cake against the wellbore wall or pore space in open (uncased) formations, so that excess hydrostatic pressure exerted in the wellbore by the drilling fluid (which is ordinarily higher than the fluid pressure in the pore space of the formation) and the drilling process can be contained without drilling fluid flowing into the pore space of the open hole formation or fluid in the pore space of the formation flowing into the wellbore. Although some losses of drilling fluid will be observed in normal drilling operations (filtrate loss, spurt losses, etc.) the drilling fluid is designed to cover permeable portions of uncased wellbore with an impermeable barrier called "filter cake" so that the excess hydrostatic pressure of the drilling fluid can be contained and further loss of drilling fluid into permeable formations can be stopped. If the drilling fluid and chemicals used in the drilling operations cannot build a certain overbalance with the formation pressure in the underground, there are left only two viable options to drill such formations; 1) drill with mud cap procedures, which means any methods where everything pumped into the well through the drill string or into the marine riser and the drill cuttings, are discharged (injected/pumped) into the underground formation void space. 2) Drill with returns up the annulus wellbore to the rig where there also are contributions from formation fluids being produced, which is often defined as underbalanced drilling.

Although underbalanced drilling often is performed on land or from fixed (e.g., bottom supported) marine drilling platforms, such drilling practices are seldom performed from a floating drilling platform or with a low pressure marine drilling riser for safety reasons and due to practicable constraints with such drilling practices on floating drilling platforms. Methods according to the present disclosure may also in addition to mud cap methods include options and methods to safely perform underbalanced drilling from a floating drilling platform connected to a subsea wellhead with a low pressure marine drilling riser.

The drilling fluid used in conventional drilling is also the primary barrier in the well preventing the fluids contained in the pore space of the rocks/formations from entering the wellbore and flow out of the well in an uncontrolled manner. Therefore the hydrostatic pressure exerted on the wellbore at any depth by the drilling fluid must be equal to or greater than the fluid pressure in the pore space of the rock or formation. The second barrier preventing uncontrolled flow from the underground formation is ordinarily a pressure control device coupled to a surface casing cemented into the well from the water bottom down to a selected depth in the wellbore. Such a pressure control device is known as a subsea blow out preventer (BOP). A subsea BOP can isolate the wellbore outside the drill string and contain any pressure in the wellbore originating from below the BOP. The BOP also includes sealing elements that are able to cut any tubulars run into the wellbore, e.g., drill pipe, tubing or casing, and contain any pressure from the formation after the tubular is cut.

Normally, two independent pressure barriers between the sub-bottom formations and the surroundings are required. In a subsea drilling operations, normally, the primary pressure barrier is the drilling fluid (mud) column in the wellbore and the BOP connected to the wellhead is defined as the secondary barrier.

Floating drilling operations (i.e., from a floating drilling platform on the water surface) are more critical compared to drilling from bottom supported platforms because the platform moves due to wind, waves and sea current. Further, in marine drilling the high pressure wellhead and the BOP is placed on or near the water bottom. The drilling platform at the water surface is connected to the subsea BOP and the high pressure wellhead with a marine drilling riser containing the drilling fluid that will transport the drill cuttings to the drilling platform at surface and provide the primary pressure barrier. The marine drilling riser is normally a low pressure marine drilling riser. Due to the large diameter of this riser, (frequently on the order of 19 to 20 inches in inside diameter) it has a lower internal pressure rating than the internal pressure rating requirement for the BOP and a high pressure (HP) wellhead. Therefore, smaller diameter pipes with high internal pressure ratings are extended parallel to and being attached to the lower pressure marine drilling riser main bore. The auxiliary HP lines have equal internal pressure rating to the high pressure BOP and wellhead. Normally these HP lines or pipes are called kill and choke lines. These HP lines are needed because if high pressure gas in the formations enters the wellbore, high pressures on surface will be required to be able to transport this gas out of the well in a controlled manner. The reason for the high pressure lines are the methods and procedures needed up until now on how gas is transported (circulated) out of a well under constant bottom hole pressure. Until now it has not been possible to follow these procedures using and exposing the main marine drilling riser with lower pressure ratings to such elevated pressures. Formation influx circulation from bottom of the wellbore and/or any part of the open wellbore has to be discharged from the drilling system through the HP auxiliary lines.

In addition to HP lines, there may be a third line connected to the interior of the drilling riser proximate the lower end of the riser. This line is often called the riser boost line. The riser boost line is normally used to pump drilling fluid or liquids into the main bore of the riser near the bottom thereof, to establish a circulation loop so that the fluids can be circulated in the marine drilling riser and in addition to circulation down the drill pipe up the annulus of the wellbore and riser to surface. The drilling riser is connected to the subsea BOP with a remotely controlled riser disconnect package often defined as the riser disconnect package (RDP). This means that if the drilling unit loses its position, or for weather reasons, the riser can be disconnected from the subsea BOP so that the well can be secured and closed in by the subsea BOP and the drilling platform is able to leave the drilling location or may be free to move without being subjected to equipment limitations such as positioning or limitation to the riser slip joint stroke length.

Generally, when drilling an offshore well from a floating platform or mobile offshore drilling unit (MODU), a so called "riser margin" is desirable. A riser margin means that if the riser is disconnected from the subsea BOP, the hydrostatic pressure exerted by the drilling mud in the wellbore below and the seawater hydrostatic pressure above the subsea BOP, is sufficient to maintain an overbalance against the formation fluid pressure in the exposed formation below the water bottom. When disconnecting the marine drilling riser from the subsea BOP, the hydrostatic head of drilling fluid in the wellbore and the hydrostatic pressure of sea water should be equal or higher than the formation pore fluid pressure in the exposed formations ("open hole") for a drilling operation to maintain a riser margin. Riser margin is, however, difficult to obtain, particular in deep water. In most deep water drilling it is not possible to obtain riser margin due to low drilling margin, i.e., the difference between the formation pore pressure and the strength (fracture pressure) of the underground formation exposed to the hydrostatic or hydrodynamic pressure caused by the drilling fluid.

When drilling with conventional methods by circulating the down the drill string and up the annulus, friction pressure loss from the fluid flow up the annulus will be compounded (added) to the hydrostatic pressure of the drilling fluid. This combined effect is often defined in terms of equivalent density and called Equivalent Circulating Density (ECD). This added pressure component may be substantial in deeper section of the well, in deep water, deep wells and in slim architecture wells and reach as high as 50-70 bar/725-1000 psi, which may be greater than the drilling window or the difference between pore pressure and formation strength at a given depth.

Managed pressure drilling (MPD) methods have been introduced to reduce some of the above mentioned problems. One method of MPD is the Low Riser Return System (LRRS) or here termed Controlled Mud Level (CIVIL). Such systems are explained in patent application PCT/NO02/00317 and Norwegian Patent No. 318220. Other earlier reference systems are described in U.S. Pat. Nos. 6,454,022, 4,291,772, 4,046,191 and 6,454,022.

The ability for the drilling fluid to build up a filter cake to support the differential pressure from the drilling fluid is a requirement for all conventional drilling practices to be performed when the drilling fluid hydrostatically overbalances the formation pore fluid pressure. The challenge occurs when the void space openings are so large that it is not possible to build up enough filter cake to prevent the drilling fluid from being lost into the voids or cavities of the formation. The drilling fluid, which normally has a higher density than the fluid in the void space of the formation being drilled, will then flow into the formation void space by gravity since the pressure in the wellbore will be higher than the pressure in the formation pore space by design and by requirement. This process will therefore not be controllable by conventional drilling practices and the hydrostatic pressure (head) in the wellbore will just fall (since the productivity is functionally infinite in cave or large open fracture systems) and level out when the hydrostatic pressure in the bottom of the wellbore equals the highest permeable pore pressure in the open hole formation capable of flowing. The hydrostatic pressure from the drilling fluid in the well equals the pressure of the fluid in the void space. The liquid level in the top of the well (riser) will now have fallen to a level where these pressures are equal. The speed at which this happens (fall of the drilling fluid level in the marine drilling riser is initially dependent on the pressure differential in wellbore due to the hydrostatic pressure of the drilling fluid and pressure in the void space of the formation) will be rapid at first when the riser is full or close to full and gradually decrease as the pressure in the wellbore decreases with decreasing hydrostatic head (riser mud level decreasing). When the pressure stabilizes the riser level will be static and no longer falling. However at this point it will no longer be possible to circulate the well or drill in a conventional way since everything being pumped down the drill pipe will just disappear into the void space of the formation and there will be no return coming up the annulus between the drill pipe and the casing/open hole formation, unless we by choice elected to produce formation fluids by drilling underbalanced. If any well content were allowed to migrate upwards in such a scenario it would most likely be a mixture of formation fluids and some of the annulus fluids at first.

If conditions such as the above are left uncorrected there will eventually be an inversion of the higher density drilling fluid with the lighter fluids in the void spaces of the formation. In other words the drilling fluid in the wellbore will by gravity sink while the lighter formation fluids will migrate upward. Left unattended the whole annulus of the wellbore will then become filled with the lighter formation fluid while the heavier drilling fluid will disappear into the void of the formation or bottom of the cave if the formation is karstified. If the formation content is gas or oil this could result in an uncontrolled flow from the formation to the surface if not contained or dealt with and would certainly result in a well control event requiring the BOP to be closed.

In conventional drilling and with prior known methods when encountering such formations conditions, several different procedures has been practiced often referred to as mud cap drilling. The term Mud Cap Drilling is often used to mean just about any way to drill where there are no returns to surface. Below is a description of the most common used methods that are sometimes referred to as Mud Cap Drilling.

1. Blind Drilling

Blind drilling is a method where fluid is pumped down the drill string with no returns up the annulus. Little if any fluid is pumped down the annulus. This procedure is called blind drilling because there is really no way to determine wellbore fluid conditions unless or until an influx of fluid from the formations comes to surface, and there is little, if any, warning when that occurs. For example, drilling is continued after total loss of returns. It is called "blind" because no effort is made to keep the annulus full or to maintain contact with or even to monitor the fluid level in the annulus. This means there is no way to detect an influx from the formation until either gas migrates through the annular fluid and reaches the surface, or enough influx occurs to lighten the total annular column to the point that the well can flow to surface. Blind drilling is primarily employed in situations where total losses make it impossible to circulate any fluid to surface, and there are no productive formations exposed to the wellbore.

2. Continuous Annular Injection

In continuous annular injection, fluid is pumped down the drill string, as well as the annulus continuously. For example, fluid is pumped down the drill string to clean and cool the bit and operate a drilling motor, MWD, etc. and additional fluid is continually pumped down the annulus at a rate high enough to overcome formation fluid migration velocity up the wellbore and keep everything going into the formation. If the formation pressure and annular injection friction pressure combined are less than hydrostatic of the fluid being pumped down the annulus, there will be no annular pressure at the surface (floating mud cap). If the hydrostatic pressure of the annular fluid is less than the combination of formation pressure and annular injection friction pressure then there will be positive surface annular pressure (pressurized mud cap).

3. Floating Mud Cap Drilling

The hydrostatic pressure of a full column of annular fluid is higher than the sum of formation pressure and injection friction so the fluid level remains below the surface or floats. For example, with a subsea BOP, it is possible to monitor the fluid level in the riser either with a pressure sensor on the riser or by filling one of the choke or kill lines with a fluid that is light enough to maintain a column all the way to surface and some surface shut-in pressure. Using either of these pressure monitoring techniques makes it possible to use the principles. However, due to changes in wellbore geometry, applying this method with a fluid level that can rise and fall simply by injecting in to the well (riser), requires complex calculations. For example, a given volume of formation fluid that migrates (due to differences in density with the annular fluid) above the top fracture causes a significantly different reduction in the hydrostatic pressure at the top fracture than it does at the BOP stack.

4. Pressurized Mud Cap Drilling (PMCD)

In PMCD the annulus is completely displaced or injected into the annulus of the wellbore to surface with a fluid whose hydrostatic pressure is slightly lower than formation pressure and the annulus shut-in resulting in a surface pressure that is the difference between formation pressure and the hydrostatic pressure of the annulus fluid. This method is dependent on a so called rotating control device and an annular preventer being installed in top of the riser below the slip joint in order to control and adjust the back pressure on the well. For example, a sacrificial fluid, usually seawater, is pumped down the drill string to clean and cool the bit and to power the motor, MWD, etc. When the rig mud pumps are operating, the annular pressure will increase by the friction pressure required to force fluid and cuttings into the formation. If any formation fluid migrates above the top fracture due to density differences, an increase in shut-in annular pressure will be detected and enough additional annular fluid can be injected to force the formation fluid back into the formation. By monitoring both drill pipe and annular pressures, it is possible to distinguish migration from formation plugging and to accurately calculate when conventional circulation with no losses can be resumed.

In blind drilling and floating mud cap drilling there is no control of the hydrostatic pressure in the annulus of the well. The mud level in the annulus is below surface and there is no practical way of altering the fluid level than by changing the density of the fluid in the well. This is a time consuming operation and require large volumes of drilling fluid to achieve. In continues annular injection, a constant downward flow of drilling fluid is added/injected into the void in the formation. The intention is to have a continuous downward flow preventing gravity swap of fluids/gas in the well from occurring. This method requires substantial consumption (or loss to the formation) of drilling fluid which may become very costly and unpractical from a logistic standpoint.

In PMCD the whole annulus must be displaced to a drilling fluid that has a density that is lower than what is required to balance or overbalance the pressure of the formation fluid in the void space of the formation. Hence in this scenario the drilling fluid is no longer the primary barrier in the well. A closing element on top of the marine riser that closes the annulus between the drill string and riser tube and an added backpressure is required in order to balance or overbalance the pore pressure in the formation. Besides changing the barrier diagram of the well both on the annulus and the drill pipe side will now have underbalanced fluid in the well which will negatively affect the integrity situation of the operation on a floating rig. Any loss of back pressure such as failure of the RCD, loss of integrity of the drill string, riser integrity, casing integrity, rig positioning issues, etc., will constitute a well control event. To operate with an underbalanced fluid will also increase tripping time as pipes or section of drill string must be stripped (removed or added) under pressure and the ability to run casing or other equipment into the well will be restricted. Effects from surge and swab caused by vertical rig (heave) movement is also more pronounced in a closed and pressurized system. This is particularly a serious issue due to fact that there is no overbalance with respect to formation pressure and that the formation has effectively infinite productivity. The drilling rig must also handle and store 2 different mud weight systems for at least the wellbore volume which may create logistical and practical limitations. Further if the pressure in the pore space is sub hydrostatic (i.e., less than the water hydrostatic gradient from the surface of the water) it may become very costly in order to create an underbalance fluid for such operations upon which pressure could be added.

In sum it can be considered that conventional and known methods has considerable shortcomings or require a considerable amount of added equipment and a change to the barrier philosophy when drilling into formations where conventional drilling practices cannot take place due to large natural fractures or karsts.

BRIEF DESCRIPTION OF THE DRAWINGS

FIGS. 2 through 5 show various views of an example embodiment an inline riser-connected gas separator.

DETAILED DESCRIPTION

Figure 1A:
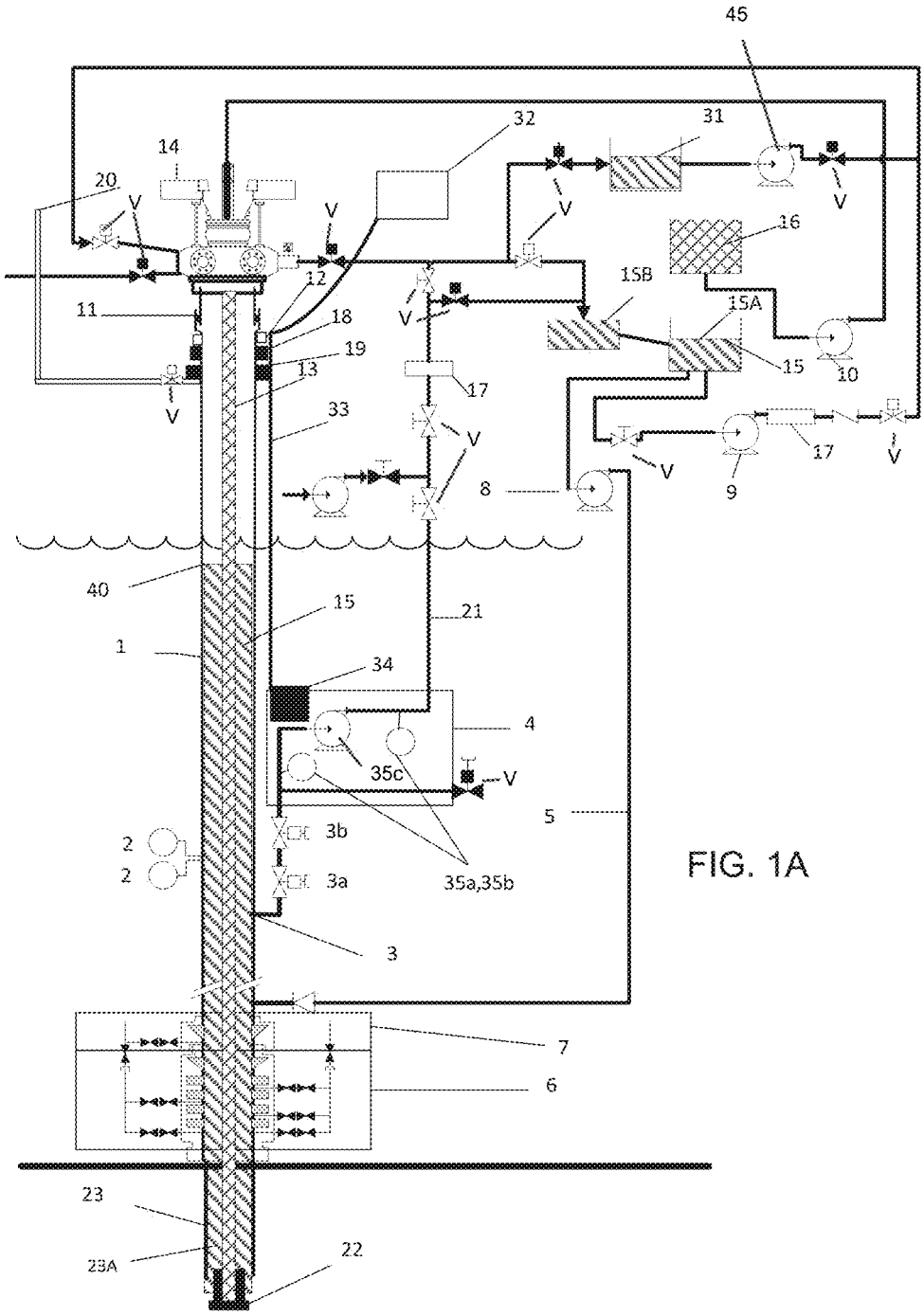
FIGS. 1A, 1B and 1C show examples embodiment of a controlled mud level marine drilling system used in, for example, controlled mud cap mode (FIG. 1A, FIG. 1C) and underbalanced drilling (FIGS. 1B and 1C).

Methods according to the present disclosure may solve several basic problems encountered with conventional drilling and with other previous methods when encountering large drilling fluid losses in a well due to severely naturally fractured formations, carbonate karsts and caves or severe downhole cross flows between formations having different pore fluid pressures. Encountering such conditions is often detrimental to the integrity of the wellbore and may cause considerable loss of progress and large cost overruns. The intention with methods and systems according to the present disclosure is to be able to regulate wellbore pressures more effectively, control formation pressure and/or minimize the amount of fluids used while drilling and operating with minimum or no pressure at the surface, making these operations safer and more effective than drilling methods known in the art.

A system and methods according to the present disclosure may be designed to manage the annular pressures in the well more effectively and to compensate for these friction pressures mentioned above. In other words, such methods may alleviate the effects of equivalent circulating density ("ECD") by compensating for such friction pressures by adjusting the hydrostatic head (height of the drilling fluid/gas or air interface) in the marine riser. In such manner the pressure in the wellbore at a particular depth of interest may be equivalently constant regardless whether the well is being circulated or whether the well is static, thereby possibly preventing severe losses of drilling fluid.

Example embodiments of controlled mud cap drilling ("CMC drilling") according to the present disclosure rely on an overbalanced fluid being present in the wellbore annulus (23A in FIG. 1A) and controlling the mud cap (liquid/gas interface level or elevation) in order to manage and control formation pressures and manage gas migration or gravity induced swap-outs. In fact, the mud density for such drilling which includes drilling fluid returns to the drilling platform by way of controlled mud level (CML) is often the same as with CMCD. The fluid interface level in the marine drilling riser (1 in FIG. 1A) maybe controlled and/or observed by a control system (32 in FIG. 1A) with the assist of a submerged mud lift pump (4) on the outside of the marine drilling riser which pumps fluid from a level inside the riser below the fluid liquid/gas-air interface. Liquid mud is injected into the riser 1 proximate the bottom of the riser through a boost line (5) and/or into the top of the riser through an auxiliary inlet. The fluid interface level in the riser is managed or the injection rate is managed and pressure observed so as to create an annular pressure profile and a hydrostatic pressure profile on the formation, or an injection rate downward in the annulus which is high enough to prevent gas or hydrocarbons entering wellbore above the highest pore pressure zone of the open hole (exposed, uncased) formations in the wellbore. The fluid in the wellbore, which may be a relatively high density or "heavy annular mud" ("HAM") has a density which is sufficient to balance or overbalance the highest expected pore pressure in the (uncased or exposed) open hole formations.

The principle of methods according to the present disclosure is based on pumping more liquid volume into the marine drilling riser than is the desired or selected annular downward flow and where subsea mud lift pump (4) pumps out the excess liquid volume in the riser and delivers such excess liquid volume to storage tanks or pits on the MODU, thereby adjusting the injection rate of a heavy annular mud in the annulus which will determine the liquid/gas interface level (mud cap) in the riser (hydrostatic head). The hydrostatic head determines how much fluid (rate of downward flow) is injected (i.e., lost) into the sub-bottom formations susceptible to intake of large volumes of fluid. Further there is another relationship between the injection or fluid loss rate and the riser liquid/gas interface level, which is the equivalent circulating density ("ECD") component. The ECD component which in conventional drilling will add pressure to the annular wellbore pressure in open (uncased or exposed) wellbore depending on the circulation rate, will, depending on the mud cap drilling mode (injection), add a hydrostatic head (liquid/gas interface level) component which will be dependent on the injection rate. Assuming bottom hole pressure (formation pressure) is relatively constant, the riser fluid liquid/gas interface level corresponding to different injection rates can hence both be measured and calculated very accurately with the disclosed apparatus and method.

Because the control system calculates the amount of gas/air and mud in the riser at all times, automatic control of the fluid injection rate can be determined and regulated.

For example, a sacrificial fluid, usually seawater, is pumped down the drill string to clean and cool the drill bit and to power a drilling motor, MWD, etc. When the drilling rig mud pumps are operating (injecting) fluid and cuttings into the formation, the annulus wellbore pressure across the "thief" zone may or may not increase depending on the injectivity of the near wellbore formation. However even relatively small changes, on the order of a few pounds per square inch of pressure change, may be detected as a change in liquid/air interface level (increase) in the riser 1. Also if any formation fluid migrates above the top of fractures or karsts/caves in the sub-bottom formations due to density differences (gravity swap) or gas migration, the mud level in the riser will increase, which will be detected instantly by the riser pressure sensors. The level of the HAM will then be measured or adjusted as the case may be by the control system that regulates the rate at which the subsea mud pump needs to extract liquid from the riser in order to obtain the required hydrostatic pressure in the wellbore and hence provide enough additional annular fluid downward (injection) flowrate that is required to be injected in annulus and therefore force any formation fluid back down into the formation void space of the underground formations thereby preventing lighter formation fluid or gas from migrating up annulus and thus to prevent fluid inversion by gravity. By monitoring drill pipe pressure and annular riser pressures, it is possible to distinguish migration from formation plugging and to calculate when conventional drilling fluid circulation with no losses can be resumed, among other things. First controlled mud level drilling will be explained in some more details.

1. Controlled Mud Level (CIVIL)

In order to improve drilling performance, managed pressure drilling ("MPD") has been introduced in to the technical field of wellbore drilling. One method of MPD is called controlled mud level ("CIVIL"), where a high density mud is used to control and overbalance the formation pressure in the open (uncased, exposed) wellbore.

One version of a CML drilling system is illustrated in FIG. 1A. Drilling fluid ("mud") 15 is circulated from mud tanks 15A located on a mobile offshore drilling unit (MODU), through drilling rig mud pumps 10, a drill string 13, and a drill bit 22 and returned up the wellbore. Note that FIG. 1A comprises a drawing of the CMC drilling system and not the CML system. In FIG. 1A, a rig pump withdraws fluid from a tank 16 which contains the same drilling fluid as is contained in tank 15. Tank 15 and tank 16 may be interconnected by suitable operation of valves V, such as solenoid operated valves. In CMC drilling mode tank 16 contains sacrificial fluid (e.g., sea water) and is not connected to tank 15 which contains heavy annular mud (HAM). Mud is returned from the wellbore 23 through an annulus 23A, through a subsea BOP 6 located on near the sea bed, through a lower marine riser package (LMRP) 7, and the marine drilling riser 1. Mud 15 then flows from the riser 1 through a fluid outlet 3 at a selected element along the riser 1 connected to an inlet of a subsea mudlift pump system 4 (in some embodiments through riser isolation valves 3A, 3B. The subsea mudlift pump system 4 outlet extends to the MODU on the water surface through a mud return line 21 back which contains a plurality of valves V and a flow meter 17, to a mud processing system 15B (e.g., shakers and degassers) on the MODU and back into the mud tanks or pits 15A. The liquid/gas interface level 40 in the riser 1 is controlled by measuring the pressure at different elevations along the riser 1, e.g., using vertically spaced apart pressure sensors 2 proximate the BOP 6 and/or the riser 1. Gas/air in the riser 1 above the liquid interface level 40 may be closed in the riser 1 using a rotating control device (RCD) 18 (if used), proximate a riser termination joint 12. Pressure build up in the riser 1 may also be controlled using a seal element such as an annular sealing element 19, disposed just below a riser termination joint 12. A riser telescoping joint 11 that extends and retracts in length above the riser termination joint 12 need not to be designed to hold any substantial pressure. A riser gas ventilation line 20 may be coupled to the interior of the riser 1 below the annular sealing element 19 to vent gas that accumulates in the riser above the liquid level 40. Regulating the liquid interface level 40 up or down in the marine drilling riser 1 will control and regulate the pressure in the wellbore 23 below the BOP 6.

A surface control unit 32 may be implemented, for example and without limitation, as a programmable logic controller, microcomputer or microprocessor. The surface control unit 32 accepts as input signals from the pressure sensors 2 coupled to the riser 1 and the flow meter 17 and provides as output control signals to operate a plurality of valves V, for example solenoid operated valves, and provides signals to control the pumping rate of the subsea mudlift pump system 4, the riser top fill pump 9, the mud pumps 10, and other drilling system components.

In some embodiments, a subsea control unit 34 controls and receives signals from a plurality of devices, for example on the subsea mudlift pump module 4, such as pressure and temperature sensor 35*a*, 35*b* signals upstream and downstream of a subsea pump 35*c*, riser isolation valves 3*a* and 3*b*, a seawater inlet valve V, etc. and may be in signal communication with the surface control unit 32 to control the speed of the subsea mudlift pump 35*c* in the subsea mudlift pump system. In some embodiments, the pressure sensors 35*a*, 35*b* may be in fluid communication with the inlet and the outlet of the subsea mudlift pump 35*c*, respectively to provide additional control signals for selecting the correct speed at which to operate the subsea mudlift pump system 4. Power and signal connection between the subsea control unit 34 and the surface control unit 32 may be obtained using an umbilical cable 33 extending between the subsea control unit 34 and the surface control unit 32.

By using the CML MPD system with a low fluid interface level in the riser and being able to compensate for the ECD component may offer advantages in drilling formations prone to substantial losses or during possible adverse mud cap drilling situations. Normally it is not possible to predict when and if a mud cap situation will be encountered in a well. Therefore, it is preferred when drilling in such formation to regulate the pressure profile in the well to be closer to the formation pore pressure profile. When and if a total loss occurs, overbalance will no longer be possible and the riser fluid interface level will drop. This will be detected essentially instantaneously by the control system 34 which will slow down or idle the subsea mud pump system 4.

Now CMC drilling will be explained in more details. Reference is made again to FIG. 1A where the drilling system is configured for mud cap drilling practice.

If a sudden loss of mud returns happen during drilling with the CML system then the procedure is to stop all pumps; the rig pumps 10 feeding the drill string 13, the riser boost pump 8 injecting drilling mud into the riser base and the riser top fill pump 9. The control system 32 will then isolate the subsea mud pump system 4 from the well by closing riser isolation valve 3*b*. Now no fluid is being injected into the riser 1 or the wellbore 23. However the riser fluid interface level 40 will still be falling due to hydrostatic overbalance with respect to the formation pressure in the exposed, uncased void space in the formation. The control system 32 will however now monitor the continuous and instantaneous loss rate corresponding to what the riser liquid interface level 40 (hydrostatic head) is in the riser. This is a very accurate measurement since it is unaffected by rig motion and the annular capacity of the riser/drill pipe is a known constant. Hence the loss rate can be plotted as a function of riser level versus loss rate against time. When the fluid interface level 40 has fallen to a pre-calculated minimum allowable loss/injection rate corresponding to a casing/drill-pipe gas free rate, the injection rate into the riser 1 is commenced by starting pumping through the riser boost pump 8 and riser top fill pump 9. Riser isolation valve 3*b* is opened and the control system 32 will regulate the subsea mud pump system 4 to provide the required net injection rate into the wellbore 23. An accurate flow meter 17 may measure the return flow from the subsea mud pump system 4 and feed this measured rate to the control system 32. The control system 32 will also monitor the measured flow rate from the top fill pump 9, flow from the riser boost pump 8, monitor the mud level in the mud pits 15 and calculate the volume of drilling fluid in the riser 1. In such a way total control of the drilling fluid in the active mud tanks 15 and the riser 1 combined can be monitored.

The purpose for including the top fill pump 9 and riser boost pump 8 is to have a constant flow of heavy annular mud (HAM) filling the riser 1 at a rate which independently is greater than the required rate to overcome gas migration in the drill string/wellbore annulus 23, in case the riser boost pump 8 or the top fill pump 9 may fail during drilling operations. By way of example, a required mud injecting rate to suppress any gas migration in the wellbore may be 200 lpm. The riser boost pump 8 may inject mud into the riser 1 through the riser boost line 5 coupled to the interior of the riser 1 at a level proximate the LMRP 7. The riser boost pump 8 may inject drilling fluid into the riser 1 at a rate of 1000 lpm; the top fill pump 9 may inject mud at 1000 lpm. The subsea mudlift pump system 4 will therefore draw 1800 lpm from the riser 1, providing a net 200 lpm fluid outflow rate from the wellbore 23 into fractures or cavities in the sub-bottom formations. If one of the two fill pumps (either the riser boost pump 8 or the top fill pump 9) fails or stops, the subsea mudlift pump system 4 controlled by the control system 32, may automatically reduce the outflow from the riser 1 correspondingly, so that the net mud injection rate into the riser 1 is maintained essentially constant.

Under the foregoing drilling conditions, if it is determined that substantial amounts of drilling mud are being lost to subsurface formations. When performing mud cap drilling procedures the rig mud pump (high pressure pump) 10 may often be used to inject a sacrificial fluid, e.g., sea water or low density drilling mud through the drill string 13. A sacrificial fluid tank 16 may store the sacrificial fluid for such use when and as needed. Such sacrificial fluid is not accounted for in the total system for maintaining and monitoring a fluid barrier in the annulus of the well.

The system may also be set to regulate so that no excess fluid is pumped into the riser. In this case the riser level will drop until it eventually stops and start to increase again. This may be caused by gas or lighter formation fluid migrating upwards and hence cause the mud cap level to rise. When that happens is that the riser level will be allowed to rise only a short distance before a greater injection rate is set up by injecting more fluid into the riser to flush the formation fluids back into the formation. This process is often defined as static observation and intermittent injection.

For relatively small amounts of gas migration from the formations it may not be necessary to close any valves in the subsea BOP 6 or LMRP 7 and use the well control system in order to continue operations. If gas starts to migrate up in the wellbore 23*a* (casing/drill pipe annulus) 2 things will happen which can be detected by the control system. 1) Since the formation bottom hole pressure is constant and the injection rate is a function of riser level (head) to overcome the friction component (ECD) of the downwards flowing mud in the annulus of the well. A rising gas will reduce the overall effective density of the fluid in the annulus hence reduce the injection rate into the formation due to less hydrostatic head. The injection rate will hence decrease with time as gas migrates and expands. 2) Since the control system is normally set for constant net loss (injection) to the formation, the riser level will increase which will be detected by the riser pressure sensors. If riser level (riser pressure) reaches certain thresholds set in the control system, a warning or alarm will be activated. This warning or alarm can be manually allowed or reset by operator or the CMCD control system will at certain levels shut down the subsea pump system 4, automatically setting up a high enough injection rate to bullhead and flush any migrating gas back to the formation void space.

Pressure in the wellbore may be simply controlled by regulating the gas/liquid level 40. Since the vertical height (head) of the drilling fluid acting on the well formation below is lower than conventional mud that flows to the top of the riser 1, the density of the drilling fluid used may be somewhat higher than conventional. Hence, the primary fluid pressure barrier in the well is the drilling mud 15 and the density and/or liquid/gas level 40 may be adjusted accordingly in order to inject intruding hydrocarbons back into the formation while working on the primary barrier. The BOP 6 is a secondary barrier but it usually will not be required to be activated for safe management of smaller amount of migration of intruding hydrocarbons.

When using the principle of having a higher fluid density (mud weight) and a lower liquid/gas interface level 40 in the riser 1 during conventional drilling, several advantages may be obtained. One such possible advantage in combining the foregoing principle with mud cap drilling (no return up annulus and all fluids going down) is in the transition phase between normal drilling and mud cap drilling. This will be explained below.

In conventional drilling, the marine drilling riser 1 is always filled to the top at the bell nipple just below the drill floor 14 and where the returned drilling fluid flows by gravity down into the mud processing equipment 15B at a lower elevation and further down in to the mud tanks 15A or pits for recirculation. In a drilling situation where large fractures or caves are encountered, the interface level 40 in the riser 1 will drop uncontrollably to a level in the riser where hydrostatic head (pressure) will equalize with the fluid pressure in the formation capable of flowing into the wellbore 23. This uncontrollable fall in the interface level 40 can be a considerable distance as the wellbore pressure with respect to the formation pressure may be substantial large. The drilling unit operator will not know what is happening in this transition period or how much fluid is being lost since the riser interface level cannot be located exactly in a conventional drilling system.

In controlled mud level drilling, however, the fluid interface level 15C in the riser 1 can be adjusted as drilling proceeds closer to areas where large fractures or caves can/may be encountered. There are very accurate pressure sensors (e.g., as shown at 2) that may be installed in the riser joint just below and/or above the riser fluid outlet 3 to the subsea mud pump 4. Pressure sensors known in the art have an accuracy of at least 0.05% and a resolution of 0.0005%. Thus, the changes in fluid interface level 40 in the riser 1 can be determined to within less than one inch (25 mm). If fractures or caves are encountered the interface level 40 will drop further but the losses and speed at which the fluid level drop occurs can be recorded and monitored as explained. Once the fluid interface level 40 stops dropping a formation pressure from formations capable of flowing into the wellbore can be determined.

Further, because the fluid level in the riser 1 is actively monitored by the control system, an accurate reading of mud losses and total volumes in the active mud tank 15A system can provide an accurate determination of the fluid dynamics and the mud volume in the wellbore 23. Therefore an immediate action to regulate the required fluid injection rate into the riser 1 and the drill string 13 can be initiated instantly and seamlessly with full control of the fluid loss rates.

The basis for applying this method is that the amount of heavy annular mud injected into the riser 1 is higher than the required rate of mud injected downward. Hence the subsea mud pump 4 will manage the difference in order to automatically control the process.

During mud cap drilling operations the fractures or caves may be filled with drill cuttings and start to plug off. If this situation occurs and sufficient formation plugging to avoid mud losses with higher overbalance occurs, a transition back to conventional drilling may take place. Such a scenario may be determined based on the measured pressure in the wellbore 23 and riser 1 by the pressure sensors 2 on the drilling riser 1, in that higher annulus fluid pressure must be added in order to obtain the desired fluid loss or fluid injection rate. If the added annulus pressure is greater than or equal to estimated and calculated friction loss due to circulating fluid through the wellbore 23 and riser 1 conventionally, options to return to conventional drilling may exist. In such a case it is beneficial to have a riser annular or gas handler 19 installed in the riser. In this way conventional circulation can take place if the gas bleed-off line 20 is connected to the rig's choke manifold (not shown). As methods according to the present disclosure can also compensate for equivalent circulating density (ECD), such transition can then be performed without much delay or requirement to change the drilling fluid density (mud weight). Systems known in the art may not be able to perform such changeover since there would be a requirement at least to change the mud weight in order to return to conventional drilling while compensating for the ECD effect at bottom of the wellbore 23.

A majority of the gas resulting from drilling that is circulated out of the wellbore with the drilling fluid into the riser, will follow the drilling fluid through the pump system into the mud process plant as in conventional drilling. This normally will not pose a problem for the pump system or the rig, as the mud process plant is set up to handle such drill gas.

Figure 1B:
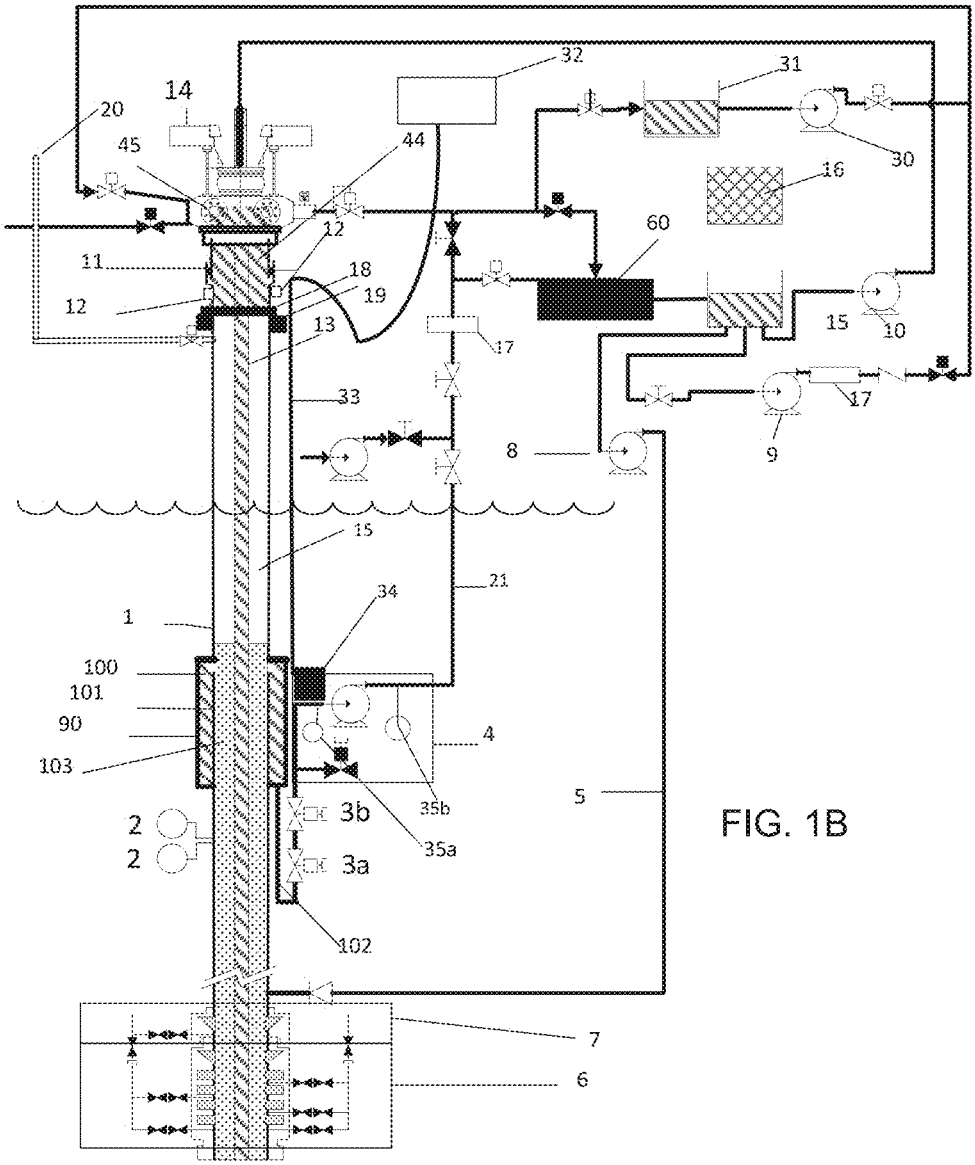

Reference is now made to FIG. 1B. If there is a large amount of free gas in the return flow being circulated, such as for underbalanced drilling (as an alternative to mud cap drilling methods) or circulating out formation influxes containing gas, such an event could be a threat to the MODU and the subsea pump system 4 would stop pumping, if circulation of free gas through the subsea pump system 4 occurs. In such an event it may be preferred to separate most of the gas coming from the subsurface within the riser and ventilate such gas at atmospheric pressure to a safe location. A sealing element such as the RCD 18 and/or riser annular sealing element 19 may then be activated to route any gas through the gas ventilation line 20 through to a safe location. In order to aid the gas separation in the riser 1 and prevent gas from escaping into the subsea mudlift pump system 4 and up to the MODU, an inline riser gas separator 90 in FIG. 1B may be installed in the riser 1. The liquid mud, formation liquids and any solids will be pumped through a liquid return line 102 into the subsea mudlift pump system 4 and out through the mud return line 21 which is full of liquid and therefor has a higher fluid pressure than the interior of the riser 1.

Referring to FIGS. 2 through 5, the riser gas separator 90 may comprise a separator chamber 100 that has an outside and inside diameter and a flow area, which is larger than the flow area of the inside diameter of the drilling riser 1 and drill string 13. The separation chamber 100 may be coupled within the riser (1 in FIG. 1B) using riser flange connections 92, 94 at each longitudinal end of the separator chamber 100. The separator chamber 100 comprises an inner flow tube 101 with an inside diameter equal or less than the diameter of the riser bore. On top of the separator chamber 100, the inner flow tube 101 has flow openings or ports 104 in the upper part which will allow for upwardly moving fluids to flow into the outer separation chamber 100A, which has an outlet 105 to an opening in an outer separation chamber 100A lower longitudinal end. The inner flow tube 101 may be centered in the ports 104 by tube guides 103. The outlet 105 connects to a fluid outlet line 102 which is connected to the suction end of the subsea mudlift pump system (4 in FIG. 1B). In some embodiments, as shown in FIG. 5, the inner flow tube 101 may be removable from the separator chamber 100, e.g., from the bottom end.

By forcing the liquids to flow into the outer separation chamber 100A with a greater flow area, the velocity of the fluid at constant flow will decrease. If the velocity of the liquid is lower than the upward slip velocity of the gas, improved separation between gas and liquid will be the result.

In order to create an effective environment for gravitational gas/liquid separation in a long vertical line or riser, the pressure within the separator must be low and preferably near atmospheric pressure (ambient pressure). When free gas expands within a liquid, the free gas will naturally migrate towards the lowest pressure which in this case will be atmospheric pressure. The relative slip velocity (i.e., the difference of velocity between the free gas and the liquid) will depend on the difference of density between the gas and the liquid, and also the viscosity of the liquid. If the direction of liquid flow within the separator is changed, and the slip velocity between the gas and the liquid is greater than the velocity of the liquid, and hence substantially complete separation between gas and liquid will take place. The gas will naturally migrate upwards towards the lowest (atmospheric) pressure in the separator. In the vent line 20 there may be an outlet which may contain a regulating valve (choke valve not drawn) which can be used to bleed off the gas pressure from the separator or riser if required. The liquid level within the separator and the riser will be regulated by the pump 4 based on measurement made by the pressure sensors 2 mounted at different vertical elevations below the separator/riser system and upstream 35*a* the sub-sea mud pump 4.

Gas which is released into the riser 1 may be diverted to the gas vent line 20 by the RCD 18, which may be disposed above the annular seal element 19 in the riser 1. The pressure in the gas filled part of the riser 1 will hence always be near atmospheric pressure even in an influx circulation process or during underbalanced drilling.

Since there is essentially no differential pressure across the RCD (18 in FIG. 1B) it may be advantageous to fill the riser with drilling mud (see 44 in FIG. 1B) above the RCD 18. By doing this and using the drilling unit conventional trip tank 31 closed circulation system, drilling mud can be circulated from the trip tank 31, by the trip tank pump 30 into the RCD housing 45 thereby providing lubrication for the riser slip joint 11 and to monitor the effectiveness of the RCD 18. Any leak in the RCD 18 may be monitored by measuring or observing the liquid level in the trip tank 31.

Performing underbalanced drilling in such a fashion may result in many safety, well integrity, economic and operational improvements over other methods. The drilling operations can be performed by using kill weight drilling fluid while having a positive riser margin. By that is meant if the drilling riser was to be disconnected from the subsea BOP, the down hole pressure would increase and put the well back to overbalance. There would be no overpressure anywhere on the rig or in the riser, meaning all lines carrying potential hydrocarbons would be at atmospheric or ambient pressure. The pressure inside the riser would be less than seawater pressure on the outside. There will be less requirement for a large gas separation plant on the deck of the MODU and a 2 phase separation unite 60, separating solids from liquids and liquid hydrocarbons from drilling fluid, could be small and compact.

Referring again to FIG. 1B, in some embodiments a drilling system is so constructed that the liquid flow in the riser enters a riser gas separator 90 coupled within the riser 1 at a selected longitudinal position, typically above the depth of a liquid return line 102. Inside the riser gas separator 90, liquid mud and entrained gas flow into an outer chamber (100A in FIG. 3; in the annular space between an inner conduit 101 and an outer housing or conduit 100) is slower than the gas migration velocity, thereby creating a separation chamber in the riser itself or in the riser gas separator 90 connected to the drilling riser's main bore.

Figure 1C:
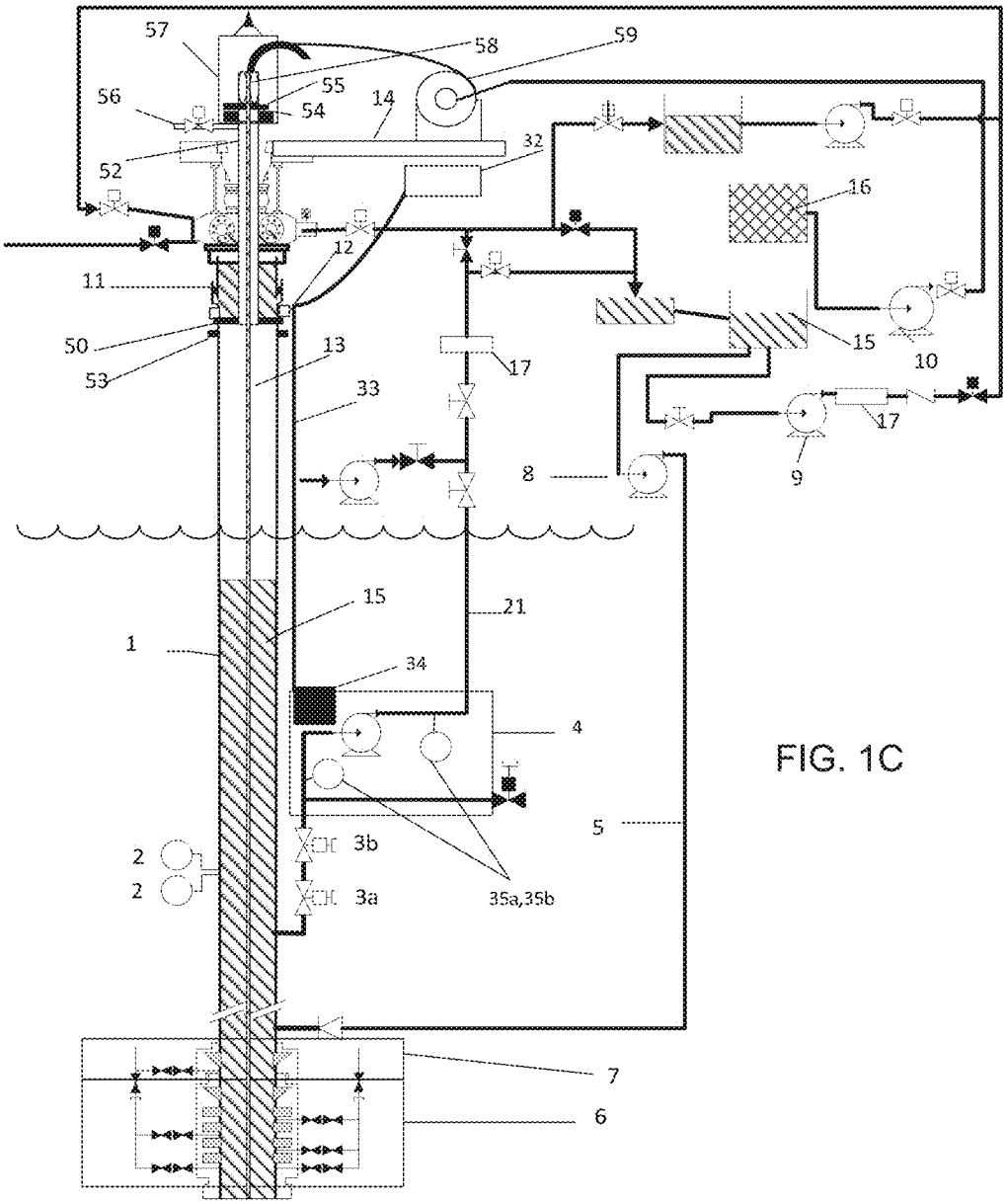

Referring to FIG. 1C, another embodiment may comprise a high pressure latch 50, in the marine riser 1 below the riser tension ring 12 and above a riser annular sealing element (19 in FIG. 1A) below the riser slip joint 11 but above the LMRP 7. Below such latch 50 there may also be an option to place a blind ram or valve (riser isolation device 53) to isolate the riser below. A coiled tubing 13C or wireline tool string (not shown) may be inserted into and are pulled out of the riser 1. Such a latch 50 may be capable of accepting a pressure tight integration of a smaller diameter and higher pressure pipe or conduit 52, to be installed inside the marine drilling riser slip joint, thereby isolating the telescoping joint 11 and be terminated in the lower end at the pressure latch 50 and above the MODU drilling floor in a compensating winch system or in the main drilling unit draw works/hoisting system. The smaller diameter extension 52 may be terminated at the upper end by a flow spool 56, coil tubing (CT) or wireline (WL) BOP 54, strippers/stuffing box 55 and injection head and goose-neck 58, so that rapid and easy integration and changeover between sectioned pipe (e.g., the drill string 13 in FIG. 1A) and reeled systems (e.g., coiled tubing unit 59 in FIG. 1C) can be used. A tension frame 57 may support the injection head and gooseneck 58 and the coiled tubing or wireline BOP 54. In the present example embodiment, a separate gas vent line 56 may be provided below the coiled tubing/wireline BOP 54. The high pressure latch 50 in the riser may also be equipped with an injection port and gas vent line 20 below the annular sealing element 13 or below the isolation device 53 in FIG. 1B. The annulus above the riser latch and the high pressure extension may be filled with drilling fluid to be effectively monitored by the trip tank 31 and trip tank pump 30 while circulating across a diverter housing 45.

The intent with the foregoing components is to offer advantages over drilling with jointed pipes from a MODU with a pumped riser, it being during conventional drilling principles, controlled mud cap principles or during underbalanced drilling.

There may be advantages of combining a system as shown in FIG. 1C with a pumped riser system (e.g., as explained with reference to FIG. 1A and FIG. 1B) on a floating MODU and particularly in deeper waters. Such advantages may be both economic and for well safety/well integrity reasons. Coiled tubing or wireline operations may be performed in the wellbore while having pressure control and eliminating the heave motions from the rig during rig up and rig down and for running long tool strings, since the riser can be isolated below and the HP extension conduit is disconnected from the latch 50 and is free to move with drilling unit as compared to coil tubing/wireline equipment.

From an a well safety standpoint there is less risk since the well can be killed with simply filling more heavy fluid into the well, regardless of whether the well is being drilled in conventional overbalanced circulation operations, under static or dynamic underbalanced operations or during mud cap drilling operations.

From an economic standpoint tripping will be much faster and fast transmittal of data from tool strings below can be transmitted to surface. By having real-time communication with pressure sensors downhole (wire inside coil tubing) and linked to the pressure control system 32 on surface, faster and more precise downhole control can be achieved.

Conceivably this smaller conduit 52 could also be equipped with a false rotary and a RCD allowing jointed pipe to be run in the well while keeping the strippers and RCD above the rig floor static compared to the MODU which heaves.

Figure 6:
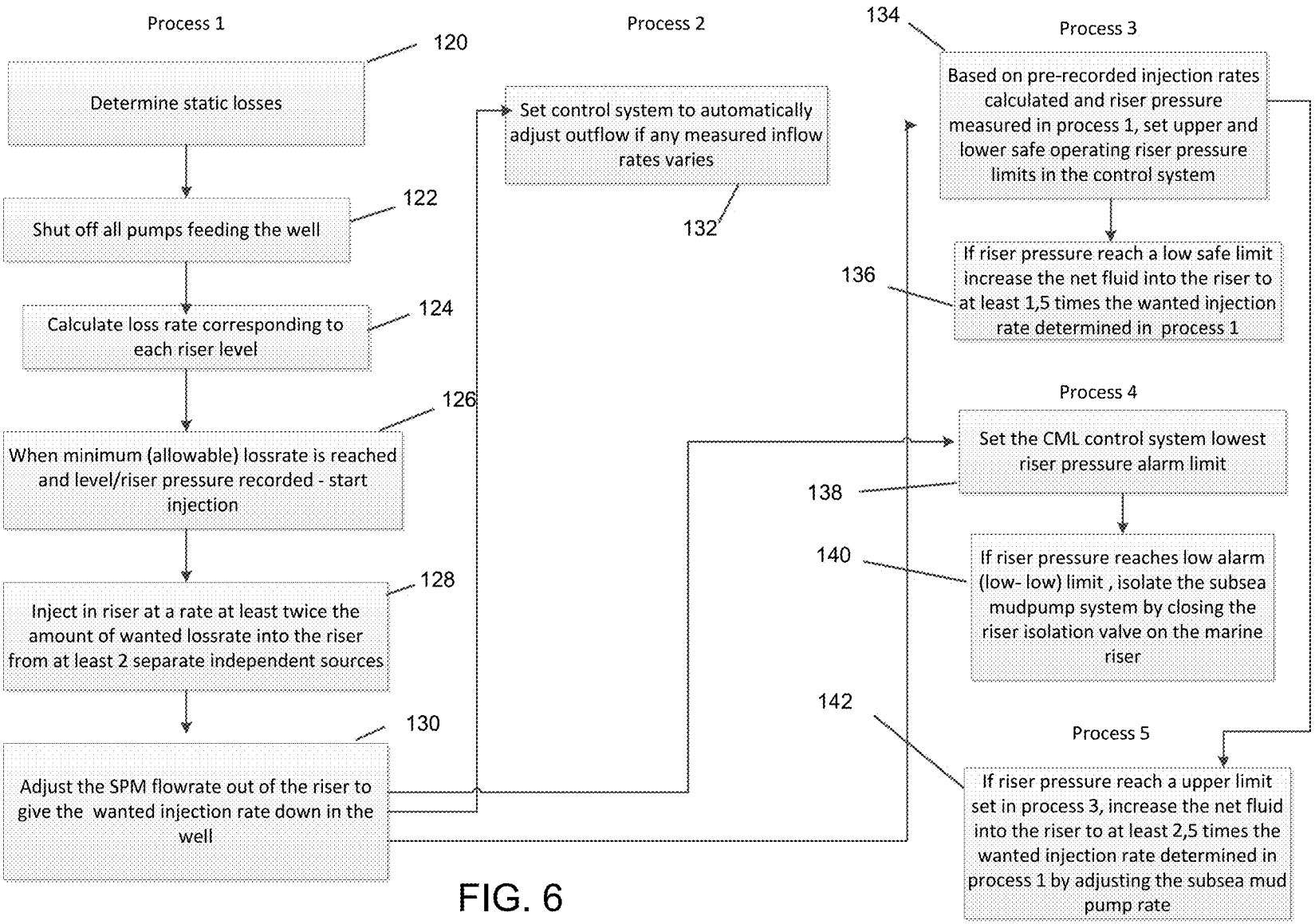
FIG. 6 shows a flow chart of various example embodiments of controlled mud cap drilling methods according to the present disclosure.

FIG. 6 shows a flow chart of example implementations of methods according to the present disclosure. At 120, static fluid losses are determined. At 122, all pumps and pump systems introducing into or removing fluid from the well are stopped. At 124 a fluid loss rate is calculated based on time-dependent changes in the interface level as determined, for example, by measurements of pressure sensors 2 as shown in FIG. 1A. At 126 when the minimum predetermined loss rate and the corresponding interface level is reached, fluid injection into the riser and well commences. At 128, the injection rate may be set to at least twice the determined loss rate (e.g., from at least two separate and independent sources). At 130 the flow rate of the subsea mudlift pump system (4 in FIG. 1A) may be set so that the desired fluid injection rate into the well is maintained.

At 132, the control system (32 in FIG. 1A) automatically adjusts the fluid outflow rate from the well with respect to the total inflow rate to give the required injection rate. This rate should then correspond to the pressure measured at 124 for that rate At 134, upper and lower safe operating riser pressures are set and input to the control system (32 in FIG. 1A) based on the recorded data from 124. At 136 if the riser pressure decreases to a lower safe pressure limit, the net fluid inflow rate to the riser is increased, for example to at least 1.5 times the rate determined for static conditions as set forth with reference to 126.

At 138, the control system (e.g., 32 in FIG. 1A) may be configured to in CMC drilling mode by setting a lowest safe limit (alarm limit). At 140, if the lowest safe riser pressure limit is reached, the subsea mudlift pump system 4 will be isolated such as by closing at least one of the valves (35*a*, 35*b* in FIG. 1A). This will set up a very high injection rate into the riser.

At 142, if the riser fluid pressure reaches an upper safe limit, the net fluid rate injected into the riser may be increased, e.g., to at least 2.5 times the desired net inflow rate by adjusting the outflow from the riser as assisted by the subsea mudlift pump system.

Figure 7:
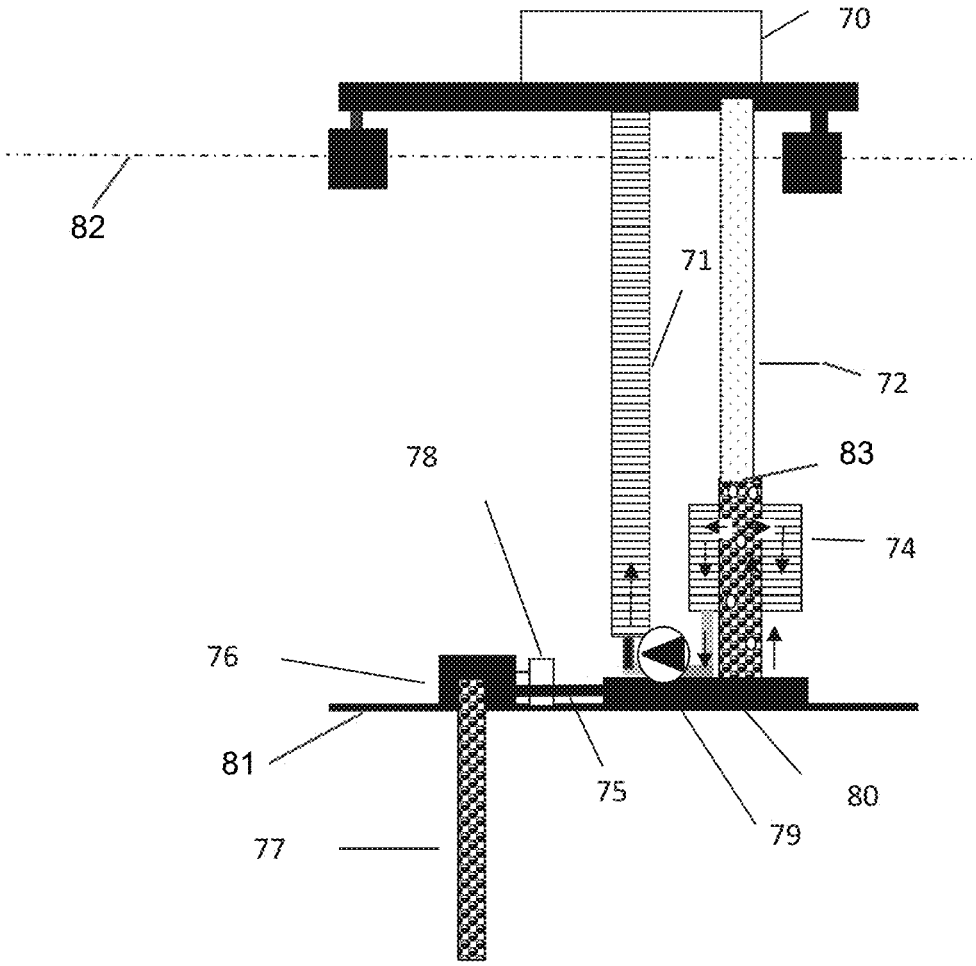
FIG. 7 shows an example embodiment of a subsea production well having a gas separator in a fluid line.

FIG. 7 shows a subsea production well 77 terminated in a subsea production tree 76 disposed on the bottom 81 of a body of water (e.g., the seabed), where produced fluid from an underground formation containing water and/or oil and gas, flows through the subsea production tree 76, a subsea production choke system 78, into a flowline 75 and then into a production manifold or riser base 80 containing one or a plurality of production risers 71, 72. In the lower end of one of the production risers 72 an inline gas/liquid separator 74, which may be configured as explained with reference to FIGS. 2-5, is installed near the base of one riser 72. Such riser 72 may connected at its upper end to a production process platform 70 disposed on the surface 82 of the water. The riser 72 and the gas/liquid separator 74 may have one or more pressure sensors and other instrumentation (not shown) in its lower end. The riser 72 is receives produced fluids from the flowline 75 at the lowermost end of the riser 72. The gas/liquid separator 74 is coupled in the riser 72 proximate the lower end of the outer separator chamber (105 in FIG. 3) and may be fluidly connected at its liquid outlet (102 in FIG. 3) to a liquid subsea booster pump 79 disposed on the subsea manifold/riser base 80. The liquid booster pump 79 pumps the liquid separated by the separator 74 into a flexible or rigid production riser 71 which may also be connected to the production process platform 70. The liquid product riser may be coupled through a flexible riser to a floating production, storage and offloading vessel (FPSO, not shown) on the water surface 82. In some embodiments, the liquid separated by the separator 74 may be pumped to a subsea oil/water separator (not shown) disposed on the subsea manifold base 80, before separated oil therefrom is pumped to surface. Separated water from the foregoing separator then may be injected into a subsea injection well or disposed into the surrounding sea.

A gas liquid interface 83 level in the first riser 72 is controlled by the pump and is located substantially below the water surface 82 and proximate the top of the separator 74.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for drilling wells in a body of water from a Mobile Offshore Drilling Unit (MODU) on a surface of the body of water, the method comprising:

operating a drilling apparatus comprising a marine drilling riser extending from the MODU to a blowout preventer (BOP) on a bottom of the body of water, with at least one fluid return outlet in fluid communication with an interior of the marine drilling riser coupled to an inlet of a subsea mudlift pump, an outlet of the subsea mudlift pump connected to a return line extending to the MODU, an interface of gas and liquid in the marine drilling riser disposed at an elevation below the surface of the body of water, a conduit extending from the MODU through the marine drilling riser and BOP into a wellbore extending below the bottom of the body of water and penetrating a formation below the bottom of the body of water;

pumping a liquid into an annular space in the marine drilling riser external to the conduit nested in the riser, through an exterior line on the marine drilling riser in fluid communication with the annular space at a top of the marine drilling riser and at a location along the marine drilling riser, through at least two distinct lines each connected to an additional pump, where both additional pumps pump at a higher rate than a wellbore fluid loss rate into an annulus between the wellbore and the conduit, wherein excess liquid pumped into the marine drilling riser by the additional pumps as required to maintain the interface level is pumped back to the MODU by controlling the pumping rate of the subsea mudlift pump, thereby controlling fluid loss rate into the formation; and at least one of, decreasing the pumping rate of the subsea mudlift pump when the interface level drops to a predetermined minimum level, while maintaining a pumping rate of the additional pumps and increasing the pumping rate of the subsea mudlift pump when the interface level rises to a predetermined maximum level, while maintaining a pumping rate of the additional pumps.

2. The method as claimed in claim 1 wherein the interface elevation is determined by measuring pressure in the marine drilling riser at least two sensors positioned below the interface level within the marine drilling riser.

3. The method as claimed in claim 2 further comprising, when a stable interface level and injection rate have been reached, pumping into the conduit a sacrificial fluid having a density less than a density of the liquid pumped into the marine drilling riser.

4. The method as claimed in claim 3 wherein the sacrificial fluid comprises sea water.

5. The method as claimed in claim 1 wherein the additional pumps comprise a first pump having an outlet directed to the top of the marine drilling riser and a second pump having a fluid outlet proximate a base of the marine drilling riser above the BOP.

6. The method as claimed in claim 1 further comprising isolating the subsea mudlift pump from the marine drilling riser when the interface level reaches the predetermined minimum level.

7. The method as claimed in claim 6 wherein the isolating comprises operating valves disposed within a fluid connection to an inlet of the subsea mudlift pump.

8. The method as claimed in claim 1 wherein a rate of the subsea mudlift pump is adjusted down with the same amount to compensate for lost pumping volume if one of the additional pumps fails.

9. The method as claimed in claim 1 further comprising:

inserting fluid into a space above a rotating control device proximate the top of the marine drilling riser below a riser telescopic joint to obtain a fluid level above the rotating control device to normal conventional return level in the riser, wherein the marine drilling riser below the rotating control device is at least partially filled with gas/air and has a pressure lower than the liquid pressure directly above the rotating control device; and determining the condition of the rotating control device from a measured level in a mud trip tank.

10. The method of claim 1 wherein the conduit comprises a coiled tubing.

* * * * *